US007111847B2

(12) United States Patent
Larson et al.

(10) Patent No.: US 7,111,847 B2
(45) Date of Patent: Sep. 26, 2006

(54) SELF-DISPENSING BULLET TRAP BUFFER BLOCK

(75) Inventors: Steven L. Larson, Vicksburg, MS (US); Charles A. Weiss, Jr., Clinton, MS (US); Joe G. Tom, Vicksburg, MS (US); Philip G. Malone, Vicksburg, MS (US); Edward J. Fransen, Irvine, CA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 27 days.

(21) Appl. No.: 10/911,771

(22) Filed: Aug. 4, 2004

(65) Prior Publication Data

US 2005/0006849 A1 Jan. 13, 2005

Related U.S. Application Data

(63) Continuation-in-part of application No. 10/307,427, filed on Dec. 2, 2002, now Pat. No. 6,837,496.

(51) Int. Cl.
*F41J 1/12* (2006.01)

(52) U.S. Cl. ..... 273/410

(58) Field of Classification Search ..... 273/404–410; 106/674; 428/76, 312, 4; 264/42; 451/359
See application file for complete search history.

(56) References Cited

U.S. PATENT DOCUMENTS 4,057,608 A * 11/1977 Hashimoto et al. ..... 264/42
4,113,913 A * 9/1978 Smiley ..... 428/312.4
4,706,416 A * 11/1987 Kottas ..... 451/359
5,435,571 A 7/1995 Wojcinski et al.
5,607,163 A 3/1997 Nesler
5,848,794 A 12/1998 Wojcinski et al.
5,901,960 A 5/1999 Nesler et al.
5,942,306 A * 8/1999 Tom et al. ..... 428/76
6,000,700 A 12/1999 Nesler et al.
6,027,120 A 2/2000 Wojcinski et al.
6,173,956 B1 1/2001 O'Neal
6,264,735 B1 7/2001 Bean et al.
6,293,552 B1 9/2001 Wojcinski et al.
6,378,870 B1 4/2002 Sovine
6,446,974 B1 9/2002 Malone et al.
6,485,561 B1 * 11/2002 Dattel ..... 106/679
6,573,358 B1 6/2003 Michels et al.
6,620,236 B1 9/2003 Huntsman et al.
6,688,811 B1 2/2004 Forrester

* cited by examiner

*Primary Examiner*—Mark S. Graham
(74) *Attorney, Agent, or Firm*—Scott A. Felder; Nicholas J. Landau; Earl H. Baugher, Jr.

(57) ABSTRACT

An additive for buffering a projectile trapping medium and spent projectiles trapped therein is a buffering compound formed as a low density foamed concrete block that will self-dispense via fragmentation or pulverization when subjected to incoming fire. The block combines at least one dry component selected from the group consisting of low solubility phosphate compounds, low solubility aluminum compounds, iron compounds, sulfate compounds, and calcium carbonate with a cementing material, water, and an aqueous based foam in substantially stoichiometric amounts. The aqueous based foam is added in a quantity sufficient to adjust the density of the resulting block to be non-buoyant without sinking in the projectile trapping medium. The additive may be employed in a projectile trapping medium to chemically stabilize the medium and environmentally stabilize projectiles trapped therein.

9 Claims, No Drawings

SELF-DISPENSING BULLET TRAP BUFFER BLOCK

This application is a continuation-in-part of application Ser. No. 10/307,427, filed Dec. 2, 2002 now U.S. Pat. No. 6,837,496.

STATEMENT REGARDING FEDERALLY SPONSORED RESEARCH OR DEVELOPMENT

The invention described herein may be manufactured and used by or for the United States Government for governmental purposes without the payment of any royalties thereon.

BACKGROUND OF THE INVENTION

1. Field of the Invention

The present invention relates generally to the firing of projectiles on a range, and, more particularly, to stabilizing and passivating munitions fired on a range.

2. Background Description

In order to maintain proficiency in the use of firearms, it is common to engage in target practice on a training range. Traditionally, the primary concern on a training range has been the prevention of ricochets. Thus, ranges often use a large dirt berm behind the target to decelerate and trap the bullet.

In addition to preventing ricochets, considerable concern has recently been raised about the environmental impact of heavy metals (e.g., lead, tungsten, copper) contained within the bullet. Though a bullet fired into a mound of dirt is safe insofar as it is no longer a dangerous projectile, heavy metals within the bullet remain free to leach into the soil, thereby contaminating the environment. Thus, shooting ranges have begun to stress containment and removal of expended rounds in order to minimize environmental contamination.

Thus, current trends in bullet containment systems focus on two different types of systems. The first, often called a bullet stop and containment chamber, has a pair of plates that channel bullets toward an opening in a containment chamber. Inside the containment chamber are impact plates that slow the bullet to a stop. Rounds may then be reclaimed from the containment chamber. Unfortunately, such systems are relatively expensive and difficult to manufacture and maintain.

The second type of containment system is the bullet backstop or bullet trap system. Bullet backstops typically include a back plate made of steel inclined to the line of fire. On an upper surface of the back plate, a layer of material is disposed to provide a medium for decelerating and trapping bullets. This layer is several feet thick in the direction the bullet travels. The impact material is typically a resilient granular material. As a bullet impacts the material, it will decelerate sufficiently such that, if it does impact the back plate, any ricochet will be minimal. Rounds may periodically be mined from the impact material.

A number of bullet traps utilize rubber chunks or chips as the impact material. For example, U.S. Pat. No. 6,378,870 to Sovine ("the '870 patent") teaches the use of relatively large rubber nuggets disposed along a plane inclined to the line of fire, while U.S. Pat. No. 5,848,794 to Wojcinski et al. ("the '794 patent") discloses a similar bullet trap using relatively small rubber granules disposed along an inclined plane.

Though these systems trap the bullet and reduce impact hazards, they generally do nothing to stabilize them from an environmental standpoint while they remain in the trap.

While some extant systems teach the use of stabilizing or passivating additives to minimize environmental hazards, they generally teach the use of powdered or granular additives. For example, U.S. Pat. No. 6,688,811 to Forrester ("the '811 patent") teaches the use of a granular additive that is essentially a slow-release phosphate fertilizer added to the projectile impact area as suggested by the Environmental Protection Agency (EPA). These granular and powdered additives have a tendency to settle as the trap is vibrated by incoming fire or wash out when the trap is wetted. Either event has a deleterious effect on the concentration and distribution of buffering compound within the trap. Thus, there remains a need to either periodically replenish the additives or recover expended rounds from the bullet traps to prevent heavy metal leaching and associated environmental contamination.

SUMMARY OF THE INVENTION

Accordingly, it is an object of the present invention to provide an additive capable of environmentally stabilizing spent projectiles trapped in a projectile trap.

Another object of the present invention is to provide an additive capable of chemically stabilizing hydrated super absorbent polymer (SAP) gels used in a projectile trap.

Yet another object of the present invention is to provide a long lasting additive for projectile traps.

Still another object of the present invention is to provide an additive for projectile traps that will ensure a consistent and useful distribution and concentration of buffering compound within the trap.

The present invention is an additive for buffering a projectile trapping medium and spent projectiles trapped therein. The additive is a buffering compound formed as a low density foamed concrete block that will self-dispense via fragmentation when subjected to incoming fire. The block combines at least one dry component selected from the group consisting of low solubility phosphate compounds, low solubility aluminum compounds, iron compounds, sulfate compounds, and calcium carbonate with a cementing material, water, and an aqueous based foam in substantially stoichiometric amounts. The aqueous based foam is added in a quantity sufficient to adjust the density of the resulting block to be non-buoyant without sinking in the projectile trapping medium.

The additive may be employed in a projectile trapping medium to passivate and stabilize the medium and projectiles trapped therein. The blocks are placed in contact with the projectile trapping medium and subjected to incoming fire. Once fragmented by incoming fire, the buffering compound reacts with the lead in spent projectiles to form an environmentally stable lead compound. The preferred buffering additives react with lead to form pyromorphite, plumbogummite, and corkite, thereby preventing leaching of heavy metals into the environment. For projectile trapping mediums that employ hydrated super absorbent polymer (SAP) gels, the additive further serves to maintain the pH of the projectile trapping medium in a range where the SAP gel is chemically stable.

Further advantages of the present invention will be apparent from the description below.

DETAILED DESCRIPTION OF PREFERRED EMBODIMENTS OF THE INVENTION

The present invention is an additive for stabilizing and passivating (herein collectively referred to as buffering) a projectile trapping medium (e.g., a resilient granular ballistic medium) and spent projectiles trapped therein. (It should be understood that the terms "bullet," "projectile," and "round" are used interchangeably herein and refer to projectiles or munitions of any sort or caliber.) The additive is a buffering compound formed as a weakly cemented, low-density block. Such a weakly cemented block will self-dispense via fragmentation or pulverization when struck by incoming rounds, thereby increasing the concentration and distribution of the buffering compound in the projectile trapping medium.

The low density, self-dispensing, foamed concrete block combines one or more dry components, selected from the group consisting of low solubility phosphate compounds, low solubility aluminum compounds, iron compounds, sulfate compounds, and calcium carbonate, with a cementing material, water, and an aqueous based foam. The cementing material, which acts as a binder, is preferably either portland cement or gypsum cement, though one skilled in the art will recognize that other cementitious materials (e.g., alundum cement) may be used without departing from the scope of the invention. One skilled in the art will recognize that the dry components, cementitious material, and water must be provided in approximately stoichiometric amounts.

The aqueous based foam is added in a quantity sufficient to adjust the density of the resulting block to be sufficiently high to be non-buoyant, such that it will not float off the top of the projectile trapping medium during rains, yet sufficiently low to prevent the block from sinking in the projectile trapping medium. In essence, the density of the resulting block should approximately match the density of the projectile trapping medium. Preferably, the aqueous based foam is added in a quantity sufficient to yield a density between about 65 and 90 $lb/ft^3$. Cement-based materials in this density range typically have an unconfined compressive strength of less than 1000 $lb/in^2$. Thus, they will not produce ricochets when struck by incoming bullets. Rather, incoming bullets will break or grind the buffer blocks into fine particles that may react with any moisture or heavy metals in the projectile trapping medium, continuously replenishing the amount of buffering compound in the trapping medium. Larger fragments of the blocks, which are preferably substantially cylindrical with a diameter of between about 2.5 and 15 cm (one and six inches), will not readily dissolve, thereby reducing washout and ensuring a ready and relatively consistent supply of buffering compound. To further minimize the risk of ricochets, any cement lumps or pebbles in the block should be less than 1 cm (⅜ inch) in diameter.

The low solubility phosphate compounds are preferably selected from the group consisting of mono-, di-, and tri-basic calcium and magnesium phosphate, zinc phosphate, aluminum phosphate, and any combination thereof. The preferred low solubility aluminum compounds are from the group consisting of aluminum phosphate, aluminum metaphosphate, aluminum silicate, aluminum hydroxide, and any combination thereof. The preferred iron compounds come from the group consisting of iron oxide, iron phosphate, iron silicate, calcium iron carbonate, and any combination thereof. The preferred sulfate compounds are selected from the group consisting of calcium sulfate, iron sulfate, potassium aluminum sulfate hydrate, and any combination thereof. However, other phosphate, aluminum, iron, and sulfate compounds may be employed without departing from the scope of the present invention.

Once the self-dispensing blocks are fragmented, the buffering compound reacts with lead contained in spent rounds to form a compound that immobilizes (that is, environmentally stabilizes) the lead. The preferred compositions of buffering compound may be described by the lead compound they are capable of producing: pyromorphite ($Pb_5(PO_4)_3Cl$), plumbogummite ($PbAl_3(PO_4)_2OH_5.H_2O$), and corkite ($PbFe_3(PO_4)(SO_4)(OH)_6$). One skilled in the art will recognize that the pyromorphite additive requires a phosphate-based buffering compound, that the plumbogummite additive requires a phosphate- and aluminum-based buffering compound, and that the corkite additive requires the presence of calcium phosphate, iron, and sulfate in the buffering compound.

Generally, the pyromorphite buffering compound includes about 1 part by mass of a low solubility phosphate compound, about 1 part by mass of cementing material, and about 0.4 parts by mass of water. The plumbogummite buffering compound also includes about 0.7 parts by mass of a low solubility aluminum compound, while the corkite buffering compound also includes about 1.4 parts by mass of an iron compound and about 1 part by mass of a sulfate compound. Tables 1 through 4 present more specific illustrative formulations of these three preferred buffering compounds, though other formulations of the preferred compositions are regarded as within the scope of the present invention.

TABLE 1

| PYROMORPHITE BUFFER | |
|---|---|
| Tribasic Calcium Phosphate | 100 g |
| Calcium Carbonate | 100 g |
| Portland Cement (Type I-II) | 100 g |
| Water (sufficient to make a workable paste) | Approx. 200 g |
| Foam (to reduce density of mixture as desired) | Approx. 1,280 g/l |

TABLE 2

| PLUMBOGUMMITE BUFFER | |
|---|---|
| Tribasic Calcium Phosphate | 100 g |
| Aluminum Hydroxide (Gel Dired) | 70 g |
| Portland Cement (Type I-II) | 100 g |
| Water (sufficient to make a workable paste) | Approx. 300 g |
| Foam (to reduce density of mixture as desired) | Approx. 1,280 g/l |

TABLE 3

| CORKITE BUFFER | |
|---|---|
| Tribasic Calcium Phosphate | 50 g |
| Calcium Sulfate, Anhydrous | 20 g |
| Ferric Oxide, Anhydrous | 70 g |
| Portland Cement (Type I-II) | 50 g |
| Water (sufficient to make a workable paste) | Approx. 180 g |
| Foam (to reduce density of mixture as desired) | Approx. 1,280 g/l |

TABLE 4

| CORKITE-GYPSUM BUFFER | |
|---|---|
| Tribasic Calcium Phosphate | 50 g |
| Calcium Sulfate, Anhydrous | 20 g |
| Ferric Oxide, Anhydrous | 70 g |
| Portland Cement (Type I-II) | 50 g |
| Plaster (calcium sulfate hemihydrate) | 50 g |
| Water (sufficient to make a workable paste) | Approx. 230 g |
| Foam to reduce density of mixture | Approx. 1,280 g/l |

To form the additive, appropriate dry components and a cementing material are selected and mixed with water in substantially stoichiometric amounts to make a workable paste. One skilled in the art will recognize that additional small amounts of water may be required to increase the flowability of the paste. A quantity of aqueous based foam, sufficient to yield the desired density of the resultant additive block, is added to the paste to form a slurry. The slurry is then cast in a mold, preferably using the standard protocols for preparing foamed concrete or foamed mortar, and cured to yield a low density, self-dispensing, foamed concrete block of buffering compound.

The resulting block of buffering compound may be employed in a projectile trapping medium to passivate and stabilize the medium and spent projectiles trapped therein. One or more such blocks are placed in contact with the projectile trapping medium, for example by mixing the blocks into the projectile trapping medium or preferably by disposing the blocks over some or all of the upper surface of the projectile trapping medium. The projectile trapping medium, and therefore the blocks, are subjected to incoming fire, which pulverizes the blocks into small fragments capable of reacting with heavy metals present in spent projectiles to form a passive coating on the spent projectiles. This, in turn, prevents leaching of heavy metals into the environment. As noted above, buffering compounds introduced as self-dispensing blocks remain in the projectile trapping medium over a longer period of time than the simple application of a particulate or granular solid, and additional incoming fire merely increases the amount of buffering compound available for reaction. However, additional blocks may be added to the projectile trapping medium as necessary in order to ensure a continuous supply of buffering compound.

In testing, two-gram samples of technical grade lead powder were added to each of the buffering compounds illustrated in Tables 1 through 4 to produce a mixture of 1% lead on a dry weight basis. The lead was ground into the buffering compound using a mortar and pestle to ensure a homogenous mixture. A control sample was prepared by mixing 2 grams of lead with sufficient quartz sand to make a 200 gram sample. All samples were moistened to 40 to 50% moisture with distilled water and allowed to age for approximately 36 days at room temperature in a closed container. The samples were then submitted for testing using the Toxic Characteristics Leaching Procedure (TCLP), and the amount of lead in each TCLP extract was determined using standard analytical procedures (EPA Method 200.7). Table 5 summarizes the results.

TABLE 5

LEAD CONCENTRATION IN TCLP LEACHATE

| Buffer | Lead Concentration (ppm) |
|---|---|
| Pyromorphite | 50.8 |
| Plumbogummite | 0.35 |
| Corkite | 11.5 |
| Corkite-Gypsum | 26.4 |
| Control Sample | 279 |

Additives according to the present invention are well suited for use in a projectile trapping medium that combines a resilient granular ballistic medium (e.g., rubber chunks, wood chips, plastic scrap) with a hydrated super absorbent polymer (SAP) gel to form an "artificial soil" of ballistic medium "chunks" in an SAP gel matrix. Such cross-linked polyacrylate and polyamide SAP gels are most stable when maintained in a wet condition with a pH above 4.5, as they tend to shrink and shed water in acids. Higher alkalinities also reduce the solubility of lead and other heavy metal ions. The buffering compounds of the present invention not only passivate heavy metals in spent projectiles, but also chemically stabilize the SAP gel by maintaining the pH of the projectile trapping medium between about 8 and 10.5, inclusive. Table 6 summarizes the pH of water suspensions of the buffers presented in Tables 1–4.

TABLE 6 pH of WATER/BUFFER SUSPENSIONS

| | |
|---|---|
| Pyromorphite | pH 10.5 |
| Plumbogummite | pH 10.0 |
| Corkite | pH 10.5 |
| Corkite-Gypsum | pH 8.5 |

While the invention has been described in terms of its preferred embodiments, those skilled in the art will recognize that the invention can be practiced with modifications within the spirit and scope of the appended claims. For example, though the invention is well suited to use in a projectile trapping medium containing hydrated SAP gel, use in any type of bullet trapping medium or trap (e.g., soil berms, sand traps, and metal traps) is regarded as within the scope of the present invention. Thus, it is intended that all matter contained in the foregoing description shall be interpreted as illustrative rather than limiting, and the invention should be defined only in accordance with the following claims and their equivalents.

What is claimed is:

1. An additive for stabilizing and passivating a projectile trapping medium and spent projectiles trapped therein, said additive comprising a buffering compound formed as a low density, self-dispensing, foamed concrete block, said low density, self-dispensing, foamed concrete block comprising:

one or more dry components selected from the group consisting of low solubility phosphate compounds, low solubility aluminum compounds, iron compounds, sulfate compounds, and calcium carbonate;

a cementing material;

water; and a quantity of aqueous based foam sufficient to yield a density of said block sufficiently high to prevent said block from being buoyant and sufficiently low to prevent said block from sinking in the projectile trapping medium;

wherein said one or more dry components, said cementing material, and said water are provided in substantially stoichiometric amounts according to a formula comprising:

about 1 part by mass low solubility phosphate compound;

about 1 part by mass cementing material; and about 0.4 parts by mass water.

2. The additive according to claim 1, wherein said quantity of aqueous based foam is sufficient to yield a density of said block between about 65 and 90 lb/ft$^3$.

3. The additive according to claim 1, wherein said low solubility phosphate compounds are selected from the group consisting of monobasic calcium phosphate, dibasic calcium phosphate, tribasic calcium phosphate, monobasic magnesium phosphate, dibasic magnesium phosphate, tribasic magnesium phosphate, zinc phosphate, aluminum phosphate, and any combination thereof.

4. The additive according to claim 1, wherein said low solubility aluminum compounds are selected from the group consisting of aluminum phosphate, aluminum metaphosphate, aluminum silicate, aluminum hydroxide, aluminum oxide, and any combination thereof.

5. The additive according to claim 1, wherein said iron compounds are selected from the group consisting of iron oxide, iron phosphate, iron silicate, calcium iron carbonate, and any combination thereof.

6. The additive according to claim 1, wherein said sulfate compounds are selected from the group consisting of calcium sulfate, iron sulfate, potassium aluminum sulfate hydrate, and any combination thereof.

7. The additive according to claim 1, wherein said one or more dry components, said cementing material, and said water are provided in substantially stoichiometric amounts according to said formula and further comprising;

about 0.7 parts by mass low solubility aluminum compound.

8. The additive according to claim 1, wherein said one or more dry components, said cementing material, and said water are provided in substantially stoichiometric amounts according to said formula and further comprising;

about 1.4 parts by mass iron compound and about 1 part by mass sulfate compound.

9. The additive according to claim 1, wherein said low density, self-dispensing, foamed concrete block is substantially cylindrical and has a diameter between about 2.5 and 15 cm.

* * * * *